US010069209B2

(12) United States Patent
Ramachandran et al.

(10) Patent No.: US 10,069,209 B2
(45) Date of Patent: Sep. 4, 2018

(54) CAPACITIVELY COUPLED ANTENNA APPARATUS AND METHODS

(71) Applicant: Pulse Finland OY, Kempele (FI)

(72) Inventors: Prasadh Ramachandran, Oulu (FI); Petteri Annamaa, Oulunsalo (FI)

(73) Assignee: Pulse Finland OY, Oulunsalo (FI)

( * ) Notice: Subject to any disclaimer, the term of this patent is extended or adjusted under 35 U.S.C. 154(b) by 1071 days.

(21) Appl. No.: 13/794,343

(22) Filed: Mar. 11, 2013

(65) Prior Publication Data

US 2014/0125535 A1 May 8, 2014

Related U.S. Application Data

(60) Provisional application No. 61/723,243, filed on Nov. 6, 2012.

(51) Int. Cl.
*H01Q 9/30* (2006.01)
*H01Q 1/24* (2006.01)
(Continued)

(52) U.S. Cl.
CPC ..... *H01Q 9/30* (2013.01); *H01Q 1/243* (2013.01); *H01Q 1/52* (2013.01); *H01Q 1/521* (2013.01); *H01Q 21/28* (2013.01)

(58) Field of Classification Search
CPC ..... H01Q 9/30; H01Q 1/28
(Continued)

(56) References Cited

U.S. PATENT DOCUMENTS 2,745,102 A 5/1956 Norgorden
3,938,161 A 2/1976 Sanford
4,004,228 A 1/1977 Mullett
4,028,652 A 6/1977 Wakino et al.
4,031,468 A 6/1977 Ziebell et al.
4,054,874 A 10/1977 Pitman
4,069,483 A 1/1978 Kaloi
4,123,756 A 10/1978 Nagata et al.
4,123,758 A 10/1978 Shibano et al.
4,131,893 A 12/1978 Munson et al.
4,201,960 A 5/1980 Skutta et al.
4,255,729 A 3/1981 Fukasawa et al.
(Continued)

FOREIGN PATENT DOCUMENTS

CN 1316797 10/2007
DE 10104862 8/2002
(Continued)

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.
(Continued)

*Primary Examiner* — Dameon E Levi
*Assistant Examiner* — Walter Davis
(74) *Attorney, Agent, or Firm* — Gazdzinski & Associates, PC

(57) ABSTRACT

Capacitively coupled antenna apparatus and methods of operating and adaptively tuning the same. In one embodiment, the insertion loss component in "beside the hand/head" use scenarios is significantly reduced or eliminated such that the antenna experiences only absorptive losses (which generally cannot be avoided), and a very small insertion loss by the host device radio frequency tuner. The exemplary antenna apparatus may be configured for multi-band operation, and also has a very small form factor (e.g., 3 mm ground clearance only at the bottom of the PCB, 4 mm height in one implementation), thereby allowing for use in spatially compact host devices such as slim-line smartphones, tablets, and the like. The adaptive antenna arrangement (using capacitive feed) can be tuned such that the tuner is used in free space, and the user's hand/head tunes the antenna to the band of interest while in use.

20 Claims, 6 Drawing Sheets

(51) Int. Cl.
*H01Q 1/52* (2006.01)
*H01Q 21/28* (2006.01)

(58) Field of Classification Search
USPC ..... 343/700, 702, 745, 749; 455/101
See application file for complete search history.

(56) References Cited

U.S. PATENT DOCUMENTS 4,313,121 A 1/1982 Campbell et al.
4,356,492 A 10/1982 Kaloi
4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,653,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,835,538 A 5/1989 McKenna et al.
4,835,541 A 5/1989 Johnson et al.
4,862,181 A 8/1989 Poncedeleon et al.
4,879,533 A 11/1989 De Muro et al.
4,896,124 A 1/1990 Schwent
4,907,006 A 3/1990 Nishikawa et al.
4,954,796 A 9/1990 Green et al.
4,965,537 A 10/1990 Kommrusch
4,977,383 A 12/1990 Niiranen
4,980,694 A 12/1990 Hines
5,016,020 A 5/1991 Simpson
5,017,932 A 5/1991 Ushiyama et al.
5,043,738 A 8/1991 Shapiro et al.
5,047,739 A 9/1991 Kuokkanen
5,053,786 A 10/1991 Silverman et al.
5,057,847 A 10/1991 Vaeisaenen
5,061,939 A 10/1991 Nakase
5,097,236 A 3/1992 Waking et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,280 A 8/1995 Baudart
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,510,802 A 4/1996 Tsuru et al.
5,517,683 A 5/1996 Collett et al.
5,521,561 A 5/1996 Yrjola
5,526,003 A 6/1996 Ogawa et al.
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,566,441 A 10/1996 Marsh et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prudhomme et al.
5,668,561 A 8/1997 Perrotta et al.
5,675,301 A 10/1997 Nappa
5,689,221 A 11/1997 Niiranen
5,694,135 A 12/1997 Dikun et al.
5,696,517 A 12/1997 Kawahata et al.
5,703,600 A 12/1997 Burrell et al.
5,709,823 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,777,585 A 5/1998 Tsuda et al.
5,760,746 A 6/1998 Kawahata
5,764,190 A 6/1998 Murch et al.
5,767,809 A 6/1998 Chuang et al.
5,768,217 A 6/1998 Sonoda et al.
5,777,581 A 7/1998 Lilly et al.
5,793,269 A 8/1998 Ervasti
5,797,084 A 8/1998 Tsuru et al.
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Sekine et al.
5,943,016 A 8/1999 Snyder, Jr. et al.

(56) References Cited

U.S. PATENT DOCUMENTS 5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,052,096 A 4/2000 Tsuru et al.
6,072,434 A 6/2000 Papatheodorou
6,078,231 A 6/2000 Pelkonen
6,091,363 A 7/2000 Komatsu et al.
6,091,365 A 7/2000 Anders et al.
6,097,345 A 8/2000 Walton
6,100,849 A 8/2000 Tsubaki et al.
6,112,108 A 8/2000 Tepper et al.
6,121,931 A 9/2000 Levi et al.
6,133,879 A 10/2000 Grangeat et al.
6,134,421 A 10/2000 Lee et al.
6,140,966 A 10/2000 Pankinaho
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,218,989 B1 4/2001 Schneider et al.
6,219,532 B1 * 4/2001 Tanaka ..... H03H 7/40
455/78
6,246,368 B1 6/2001 Deming et al.
6,252,552 B1 6/2001 Tarvas et al.
6,252,554 B1 6/2001 Isohatala
6,255,994 B1 7/2001 Saito
6,259,029 B1 7/2001 Hand
6,268,831 B1 7/2001 Sanford
6,281,848 B1 8/2001 Nagumo et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,343,208 B1 1/2002 Ying
6,346,914 B1 2/2002 Annamaa
6,348,892 B1 2/2002 Annamaa
6,353,443 B1 2/2002 Ying
6,366,243 B1 4/2002 Isohatala
6,377,827 B1 4/2002 Rydbeck
6,380,905 B1 4/2002 Annamaa
6,392,610 B1 * 5/2002 Braun ..... H01Q 1/243
343/700 MS
6,396,444 B1 5/2002 Goward
6,404,394 B1 6/2002 Hill
6,417,813 B1 7/2002 Durham et al.
6,421,014 B1 7/2002 Sanad
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tsang et al.
6,462,716 B1 10/2002 Kushihi
6,469,673 B2 10/2002 Kaiponen
6,473,056 B2 10/2002 Annamaa
6,476,767 B2 11/2002 Aoyama et al.
6,476,769 B1 11/2002 Lehtola
6,480,155 B1 11/2002 Eggleston
6,483,462 B2 11/2002 Weinberger
6,498,586 B2 12/2002 Pankinaho
6,501,425 B1 12/2002 Nagumo
6,515,625 B1 2/2003 Johnson
6,518,925 B1 2/2003 Annamaa
6,529,168 B2 3/2003 Mikkola
6,529,749 B1 3/2003 Hayes et al.
6,535,170 B2 3/2003 Sawamura et al.
6,538,604 B1 3/2003 Isohatala
6,538,607 B2 3/2003 Barna
6,542,050 B1 4/2003 Arai et al.
6,549,167 B1 4/2003 Yoon
6,552,686 B2 4/2003 Ollikainen et al.
6,556,812 B1 4/2003 Pennanen et al.
6,566,944 B1 5/2003 Pehlke
6,580,396 B2 6/2003 Lin
6,580,397 B2 6/2003 Kuriyama et al.
6,600,449 B2 7/2003 Onaka
6,650,295 B2 7/2003 Ollikainen et al.
6,603,430 B1 8/2003 Hill et al.
6,606,016 B2 8/2003 Takamine et al.
6,611,235 B2 8/2003 Barna et al.
6,614,400 B2 9/2003 Egorov
6,614,401 B2 9/2003 Onaka et al.
6,614,405 B1 9/2003 Mikkoken
6,634,564 B2 10/2003 Kuramochi
6,636,181 B2 10/2003 Asano
6,639,564 B2 10/2003 Johnson
6,646,606 B2 11/2003 Mikkola
6,657,593 B2 12/2003 Nagumo et al.
6,657,595 B1 12/2003 Phillips et al.
6,670,926 B2 12/2003 Miyasaka
6,677,903 B2 1/2004 Wang
6,680,705 B2 1/2004 Tan et al.
6,683,573 B2 1/2004 Park
6,693,594 B2 * 2/2004 Pankinaho et al. .... 343/700 MS
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Varjakka
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 Johannes et al.
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.
6,897,810 B2 5/2005 Dai et al.
6,900,768 B2 5/2005 Iguchi et al.
6,903,692 B2 6/2005 Kivekas
6,911,945 B2 6/2005 Korva
6,922,171 B2 7/2005 Annamaa
6,925,689 B2 8/2005 Folkmar

(56) References Cited

U.S. PATENT DOCUMENTS 6,927,729 B2 8/2005 Legay
6,937,196 B2 8/2005 Korva
6,950,065 B2 9/2005 Ying et al.
6,950,066 B2 9/2005 Hendler et al.
6,950,068 B2 9/2005 Bordi
6,950,072 B2 9/2005 Miyata et al.
6,952,144 B2 10/2005 Javor
6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.
6,967,618 B2 11/2005 Ojantakanen
6,975,278 B2 12/2005 Song et al.
6,980,158 B2 12/2005 Iguchi et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,031,744 B2 4/2006 Kojima et al.
7,034,752 B2 4/2006 Sekiguchi et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,061,430 B2 6/2006 Zheng et al.
7,081,857 B2 7/2006 Kinnunen et al.
7,084,831 B2 8/2006 Takagi et al.
7,099,690 B2 8/2006 Milosavljevic
7,113,133 B2 9/2006 Chen et al.
7,119,749 B2 10/2006 Miyata et al.
7,126,546 B2 10/2006 Annamaa
7,129,893 B2 10/2006 Otaka et al.
7,136,019 B2 11/2006 Mikkola
7,136,020 B2 11/2006 Yamaki
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.
7,176,838 B1 2/2007 Kinezos
7,180,455 B2 2/2007 Oh et al.
7,193,574 B2 3/2007 Chiang et al.
7,205,942 B2 4/2007 Wang et al.
7,215,283 B2 5/2007 Boyle
7,218,280 B2 5/2007 Annamaa
7,218,282 B2 5/2007 Humpfer et al.
7,224,313 B2 5/2007 McKinzie, III et al.
7,230,574 B2 6/2007 Johnson
7,233,775 B2 6/2007 De Graauw
7,237,318 B2 7/2007 Annamaa
7,256,743 B2 8/2007 Korva
7,274,334 B2 9/2007 O'Riordan et al.
7,283,097 B2 10/2007 Wen et al.
7,289,064 B2 10/2007 Cheng
7,292,200 B2 11/2007 Posluszny et al.
7,319,432 B2 1/2008 Andersson
7,330,153 B2 2/2008 Rentz
7,333,067 B2 2/2008 Hung et al.
7,339,528 B2 3/2008 Wang et al.
7,340,286 B2 3/2008 Kempele
7,345,634 B2 3/2008 Ozkar et al.
7,352,326 B2 4/2008 Korva
7,355,270 B2 4/2008 Hasebe et al.
7,358,902 B2 4/2008 Erkocevic
7,375,695 B2 5/2008 Ishizuka et al.
7,381,774 B2 6/2008 Bish et al.
7,382,319 B2 6/2008 Kawahata et al.
7,385,556 B2 6/2008 Chung et al.
7,388,543 B2 * 6/2008 Vance ..... H01Q 1/243 343/700 MS
7,391,378 B2 6/2008 Mikkota
7,405,702 B2 7/2008 Annamaa et al.
7,417,588 B2 8/2008 Castany et al.
7,418,990 B2 9/2008 Vylasek
7,423,592 B2 9/2008 Pros et al.
7,432,860 B2 10/2008 Huynh
7,439,929 B2 10/2008 Ozkar
7,443,344 B2 10/2008 Boyle
7,468,700 B2 12/2008 Milosavljevic
7,468,709 B2 12/2008 Niemi
7,501,983 B2 3/2009 Mikkota
7,502,598 B2 3/2009 Kronberger
7,564,413 B2 7/2009 Kim et al.
7,589,678 B2 9/2009 Nissinen et al.
7,616,158 B2 11/2009 Mark et al.
7,633,449 B2 12/2009 Oh
7,663,551 B2 2/2010 Nissinen
7,663,555 B2 * 2/2010 Caimi ..... H01Q 1/243 343/702
7,679,565 B2 3/2010 Sorvala
7,692,543 B2 4/2010 Copeland
7,710,325 B2 5/2010 Cheng
7,724,204 B2 5/2010 Annamaa
7,760,146 B2 7/2010 Ollikainen
7,764,245 B2 7/2010 Loyet
7,786,938 B2 8/2010 Sorvala
7,800,544 B2 9/2010 Thornetl-Pers
7,830,327 B2 11/2010 He
7,843,397 B2 11/2010 Boyle
7,889,139 B2 2/2011 Hobson et al.
7,889,143 B2 2/2011 Milosavljevic
7,901,617 B2 3/2011 Taylor
7,903,035 B2 3/2011 Mikkola et al.
7,916,086 B2 3/2011 Koskiniemi et al.
7,963,347 B2 6/2011 Pabon
7,973,720 B2 7/2011 Sorvala
8,049,670 B2 11/2011 Jung et al.
8,054,232 B2 11/2011 Chiang et al.
8,098,202 B2 1/2012 Annamaa et al.
8,179,322 B2 5/2012 Nissinen
8,193,998 B2 6/2012 Puente et al.
8,378,892 B2 2/2013 Sorvala
8,466,756 B2 6/2013 Milosavljevic et al.
8,473,017 B2 6/2013 Milosavljevic et al.
8,564,485 B2 10/2013 Milosavljevic et al.
8,629,813 B2 1/2014 Milosavljevic
2001/0050636 A1 12/2001 Weinberger
2002/0183013 A1 12/2002 Auckland et al.
2002/0196192 A1 12/2002 Nagumo et al.
2003/0146873 A1 8/2003 Blancho
2004/0090378 A1 5/2004 Dai et al.
2004/0137950 A1 7/2004 Bolin et al.
2004/0145525 A1 7/2004 Annabi et al.
2004/0171403 A1 9/2004 Mikkola
2005/0055164 A1 3/2005 Neff et al.
2005/0057401 A1 3/2005 Yuanzhu
2005/0159131 A1 7/2005 Shibagaki et al.
2005/0176481 A1 8/2005 Jeong
2006/0071857 A1 4/2006 Pelzer
2006/0192723 A1 8/2006 Harada
2007/0042615 A1 2/2007 Liao
2007/0082789 A1 4/2007 Nissila
2007/0152881 A1 7/2007 Chan
2007/0188388 A1 8/2007 Feng
2008/0059106 A1 3/2008 Wight
2008/0088511 A1 4/2008 Sorvala et al.
2008/0266199 A1 10/2008 Milosavljevic et al.
2009/0009415 A1 1/2009 Tanska
2009/0135066 A1 5/2009 Raappana et al.
2009/0153412 A1 6/2009 Chiang et al.
2009/0174604 A1 7/2009 Keskitalo et al.
2009/0196160 A1 8/2009 Crombach
2009/0197654 A1 8/2009 Teshima
2009/0231213 A1 9/2009 Ishimiya
2010/0220016 A1 9/2010 Nissinen
2010/0244978 A1 * 9/2010 Milosavljevic ..... H04B 1/0458 333/33
2010/0309092 A1 12/2010 Lambacka
2011/0027413 A1 2/2011 Jia et al.
2011/0133994 A1 6/2011 Korva

(56) References Cited

U.S. PATENT DOCUMENTS

| | | | | |
|---|---|---|---|---|
| 2011/0207413 | A1 | 8/2011 | Su et al. | |
| 2012/0044114 | A1* | 2/2012 | Eom | H01Q 1/243 343/702 |
| 2012/0119955 | A1 | 5/2012 | Milosavljevic et al. | |

FOREIGN PATENT DOCUMENTS

| | | |
|---|---|---|
| DE | 10150149 | 4/2003 |
| EP | 0 208 424 | 1/1987 |
| EP | 0 376 643 | 4/1990 |
| EP | 0 751 043 | 4/1997 |
| EP | 0 807 988 | 11/1997 |
| EP | 0 831 547 | 3/1998 |
| EP | 0 851 530 | 7/1998 |
| EP | 1 294 048 | 1/1999 |
| EP | 1 014 487 | 6/2000 |
| EP | 1 024 553 | 8/2000 |
| EP | 1 067 627 | 1/2001 |
| EP | 0 923 158 | 9/2002 |
| EP | 1 329 980 | 7/2003 |
| EP | 1 361 623 | 11/2003 |
| EP | 1 406 345 | 4/2004 |
| EP | 1 453 137 | 9/2004 |
| EP | 1 220 456 | 10/2004 |
| EP | 1 467 456 | 10/2004 |
| EP | 1 753 079 | 2/2007 |
| FI | 20020829 | 11/2003 |
| FI | 118782 | 3/2008 |
| FR | 2553584 | 10/1983 |
| FR | 2724274 | 3/1996 |
| FR | 2873247 | 1/2006 |
| GB | 2266997 | 11/1993 |
| GB | 2 330 965 | 5/1999 |
| GB | 2360422 | 9/2001 |
| GB | 2 366 081 | 2/2002 |
| GB | 2389246 | 12/2003 |
| JP | 59-202831 | 11/1984 |
| JP | 60-206304 | 10/1985 |
| JP | 61-245704 | 11/1986 |
| JP | 06-152463 | 5/1994 |
| JP | 07-131234 | 5/1995 |
| JP | 07-221536 | 8/1995 |
| JP | 07-249923 | 9/1995 |
| JP | 07-307612 | 11/1995 |
| JP | 08-216571 | 8/1996 |
| JP | 09-083242 | 3/1997 |
| JP | 09-260934 | 10/1997 |
| JP | 09-307344 | 11/1997 |
| JP | 10-028013 | 1/1998 |
| JP | 10-107671 | 4/1998 |
| JP | 10-173423 | 6/1998 |
| JP | 10-209733 | 8/1998 |
| JP | 10-224142 | 8/1998 |
| JP | 10-322124 | 12/1998 |
| JP | 10-327011 | 12/1998 |
| JP | 11-004113 | 1/1999 |
| JP | 11-004117 | 1/1999 |
| JP | 11-068456 | 3/1999 |
| JP | 11-127010 | 5/1999 |
| JP | 11-127014 | 5/1999 |
| JP | 11-136025 | 5/1999 |
| JP | 11-355033 | 12/1999 |
| JP | 2000-278028 | 10/2000 |
| JP | 2001-053543 | 2/2001 |
| JP | 2001-267833 | 9/2001 |
| JP | 2001-217631 | 10/2001 |
| JP | 2001-326513 | 11/2001 |
| JP | 2002-319811 | 10/2002 |
| JP | 2002-329541 | 11/2002 |
| JP | 2002-335117 | 11/2002 |
| JP | 2003-060417 | 2/2003 |
| JP | 2003-124730 | 4/2003 |
| JP | 2003-179426 | 6/2003 |
| JP | 2004-112028 | 4/2004 |
| JP | 2004-363859 | 12/2004 |
| JP | 2005-005985 | 1/2005 |
| JP | 2005-252661 | 9/2005 |
| KR | 20010080521 | 10/2001 |
| KR | 20020096016 | 12/2002 |
| SE | 511900 | 12/1999 |
| WO | WO 1992/000635 | 1/1992 |
| WO | WO 1996/027219 | 9/1996 |
| WO | WO 1998/001919 | 1/1998 |
| WO | WO 1999/030479 | 6/1999 |
| WO | WO 2001/020718 | 3/2001 |
| WO | WO 2001/029927 | 4/2001 |
| WO | 01/31737 | 5/2001 |
| WO | WO 2001/033665 | 5/2001 |
| WO | WO 2001/061781 | 8/2001 |
| WO | WO 2004/017462 | 2/2004 |
| WO | WO 2004/057697 | 7/2004 |
| WO | WO 2004/100313 | 11/2004 |
| WO | WO 2004/112189 | 12/2004 |
| WO | WO 2005/062416 | 7/2005 |
| WO | WO 2007/012697 | 2/2007 |
| WO | 2007/128340 | 11/2007 |
| WO | WO 2010/122220 | 10/2010 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng-Nan Hu, Willey Chen, and Book Tai, "A Compact Multi-Band Antenna Design for Mobile Handsets", *APMC 2005 Proceedings*.

Endo, T., Y. Sunahara, S. Satoh and T, Katagi, "Resonant Frequency and Radiation Efficiency of Meander Line Antennas," Electronics and Commu-nications in Japan, Part 2, vol. 83, No. 1, 52-58, 2000.

European Office Action, dated May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett*, vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, "New compact six-band internal antenna," *IEEE Antennas and Wireless Propagation Letters*, vol. 3, 295-297, 2004.

Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.

Hoon Park, et al. "Design of an Internal antenna with wide and multiband characteristics for a mobile handset", *IEEE Microw. & Opt. Tech. Lett.* vol. 48, No. 5, May 2006.

Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.

(56) References Cited

OTHER PUBLICATIONS

Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.
I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/FI2004/000554, date of issuance of report May 1, 2006.
Jing, X., et al.; "Compact Planar Monopole Antenna for Multi-Band Mobile Phones"; Microwave Conference Proceedings, 4.-7.12. 2005.APMC 2005, Asia-Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wong, *Planar Antennas for Wireless Communications*, Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, Ioannis et al., "Micromachined Patch Antennas", IEEE Transactions on Antennas and Propagation, vol. 46, No. 2, pp. 275-283, Feb. 1998.
Product of the Month, RFDesign, "GSM/CPRS Quad Band Power Amp Includes Antenna Switch," 1 page, reprinted 11/04 issue of RF Design (www.ridesion.com), Copyright 2004, Freescale Semiconductor, RFD-24-EK.
S. Tarvas, et al. "An internal dual-band mobile phone antenna," in *2000 IEEE Antennas Propagat, Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi K., et al., "Broadband Concentric Rings Fractal Slot Antenna", XXVIIIth General Assembly of International Union of Radio Science (URSI). (Oct. 23-29, 2005), 4 Pgs.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "*Investigation of Low Profile Antenna Designs for Use in Hand-Held Radios*,"Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, Sep. 2002 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for EP Patent Application No. 12177740.3.
Ramachandran, "Adaptive Matching Circuitry for compensation of finger effect on handset antennas.", 3rd European Conference on Antennas and Propagation, EUCAP 2009, Mar. 2009 pp. 801-804.

* cited by examiner

CAPACITIVELY COUPLED ANTENNA APPARATUS AND METHODS

This application claims priority to co-owned and co-pending U.S. Provisional Patent Application Ser. No. 61/723,243 filed Nov. 6, 2012 of the same title, which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

Technology Field

The present disclosure relates generally to antenna apparatus for use in electronic devices such as wireless radio devices, and more particularly in one exemplary aspect to a capacitively coupled antenna apparatus, and methods of, inter alia, tuning and utilizing the same.

Description of Related Technology

Current trends in mobile wireless devices demand generally compact (e.g., thin) form factor devices with a large display. Along with these demands are operator requirements on FS (freespace) BHR/L (Beside Head Right/Left) and BHHR/L (Beside head hand right/Left) performance. Radio frequency tuners are currently being used to compensate for the antenna mismatch in beside head/hand scenarios. Typical prior art antennas are "tuned" for freespace, and the antenna thus detunes in the presence of the user's hand/head (i.e., a head/hand is a capacitive loading factor which causes detuning and mismatch of the antenna). An impedance tuner is then able to match the antenna back to a sufficient matching level. Thus, in the end, the total efficiency of the antenna in the hand/head use scenarios is equal to the total efficiency in freespace minus absorptive losses by the user's hand/head, minus the insertion loss of the tuner, and minus the mismatch loss.

The typical prior art tuner is able to remove the mismatch loss by improving the matching to the source impedance (typically 50 ohm). However, in the detuned case when the mismatch is large, the tuner also introduces a large insertion loss. Thus, the loss components include absorptive loss plus a significant insertion loss, which is not optimal.

Accordingly, there is a salient need for, inter alia, an improved antenna solution that can provide the required electrical and other performance attributes, yet with reduced insertion loss in such operational scenarios as those described above.

SUMMARY

The present invention satisfies the foregoing needs by providing, inter alia, improved antenna apparatus and methods useful in, e.g., mobile wireless devices.

In a first aspect of the invention, an antenna apparatus is disclosed. In one embodiment, the apparatus includes: a ground plane; high and low band radiator elements; and a capacitance.

In a second aspect, a method of manufacturing an antenna element is disclosed.

In a third aspect of the invention, a method of tuning an antenna is disclosed. In one embodiment, the adaptive antenna arrangement (using capacitive feed) can be tuned such that the tuner is used in free space, and the user's hand/head tunes the antenna to the band of interest while in use.

In a fourth aspect of the invention, a method of reducing the insertion loss of an antenna is disclosed.

In a fifth aspect of the invention, a method of providing a high isolation between different ports of an antenna is disclosed.

In a sixth aspect, a method of operating an antenna is disclosed. In one embodiment, the user's hand/head adaptively tunes the antenna to the band of interest while in use, the device having been tuned in freespace conditions through use of an RF tuning apparatus.

In a seventh aspect, a mobile device is disclosed. In one embodiment, the mobile device includes a housing; a wireless transceiver; an antenna in signal communication with the wireless transceiver and disposed substantially within or on the housing, the antenna including a high-band feed and a low-band feed; and a tuner in electrical communication with the antenna. The antenna being tuned using at least the tuner such that low antenna matching exists in a freespace condition, and capacitive loading imparted by a user during use of the mobile device further optimizes the antenna matching during such use without use of the tuner and separation of the high-band feed from the low-band feed is configured to improve a performance of the antenna in the freespace operating condition and in a capacitively loaded operating condition compared to performance of the antenna without the separation.

Further features of the present disclosure, its nature and various advantages will be more apparent from the accompanying drawings and the following detailed description.

BRIEF DESCRIPTION OF THE DRAWINGS

The features, objectives, and advantages of the disclosure will become more apparent from the detailed description set forth below when taken in conjunction with the drawings, wherein.

Figure 1A:
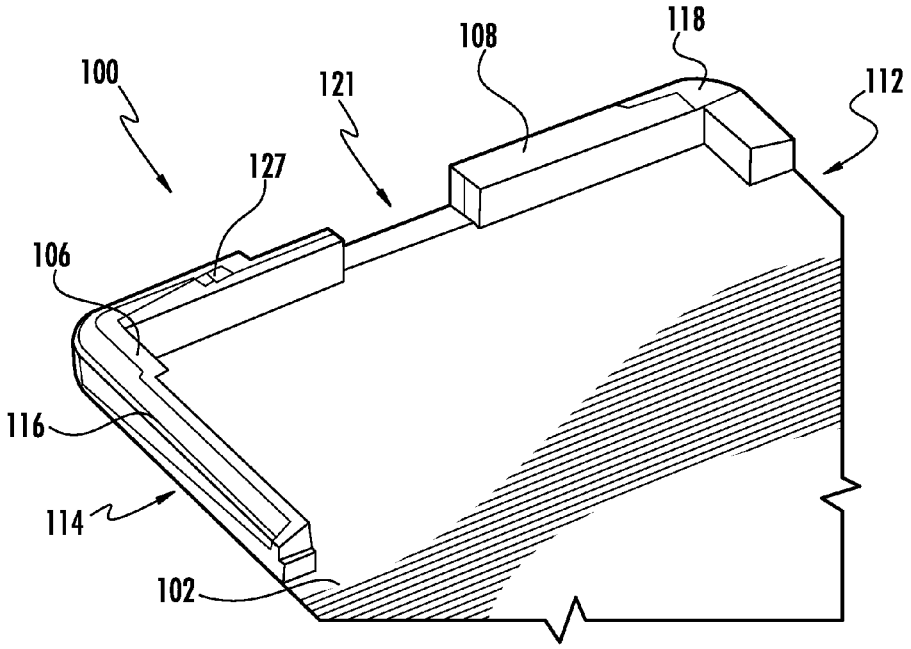
FIGS. 1A and 1B are front and rear partial perspective views of an exemplary embodiment of a capacitively coupled antenna element configured according to the disclosure.

All Figures disclosed herein are © Copyright 2012-2013 Pulse Finland Oy. All rights reserved.

DETAILED DESCRIPTION OF THE PREFERRED EMBODIMENT

Reference is now made to the drawings wherein like numerals refer to like parts throughout.

As used herein, the terms "antenna," and "antenna system," refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", "frequency band", and "frequency domain" refer without limitation to any frequency range for communicating signals. Such signals may be communicated pursuant to one or more standards or wireless air interfaces.

As used herein, the terms "portable device", "mobile device", "client device", "portable wireless device", and "host device" include, but are not limited to, personal computers (PCs) and minicomputers, whether desktop, laptop, or otherwise, set-top boxes, personal digital assistants (PDAs), handheld computers, personal communicators, tablet computers, portable navigation aids, J2ME equipped devices, cellular telephones, smartphones, personal integrated communication or entertainment devices, or literally any other device capable of interchanging data with a network or another device.

Furthermore, as used herein, the terms "radiator," and "radiating element" refer without limitation to an element that can function as part of a system that receives and/or transmits radio-frequency electromagnetic radiation; e.g., an antenna.

The terms "RF feed," "feed" and "feed conductor" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom", "side", "up", "down", "left", "right", "back", "front", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, NFC/RFID, CDPD, satellite systems such as GPS, millimeter wave or microwave systems, optical, acoustic, and infrared (i.e., IrDA).

Detailed Description of Exemplary Embodiments

Detailed descriptions of the various embodiments and variants of the apparatus and methods of the disclosure are now provided. While primarily discussed in the context of user mobile devices such as smartphones or tablet computers (or so-called "phablets"), the various apparatus and methodologies discussed herein are not so limited. In fact, the apparatus and methodologies of the disclosure may be useful in any number of antennas and/or host devices, whether associated with mobile or fixed devices.

Exemplary Antenna Element Apparatus and Methods

The present disclosure provides, in one salient aspect, an improved antenna apparatus and methods of operating and tuning the same. Specifically, in one embodiment, the insertion loss component in "beside the hand/head" use scenarios is significantly reduced or eliminated such that the antenna experiences only absorptive losses (which generally cannot be avoided), and a very small insertion loss by the host device radio frequency tuner. The exemplary antenna apparatus also has a very small form factor (e.g., 3 mm ground clearance only at the bottom of the PCB, 4 mm height in one implementation), thereby allowing for use in spatially compact host devices such as slim-line smartphones, tablets, and the like.

In one variant, a capacitively coupled antenna arrangement is used. The antenna is constructed such that in a "freespace" condition (i.e., not proximate the user), the antenna is poorly matched (considering an exemplary 50 ohm environment). But in hand/head use scenarios (which are the scenarios which users would actually be using the device), the loading by the user's hand improves the antenna's return loss (i.e., matching level) significantly, thus using the loading capacitance of the hand/head to improve the antenna matching. This approach advantageously results in the tuner having minimal insertion loss, as the matching is already very good by virtue of the foregoing loading. Alternatively, the tuner may even be bypassed in scenarios where the matching is good/suitable, thus further reducing the insertion loss.

In another embodiment, the use (or non-use of the tuner) is adaptively or dynamically varied, depending on detected operating conditions (such as by way of computerized logic resident on the host device). In this manner, the tuner (and its associated insertion loss) is only used when absolutely necessary.

Figure 1B:
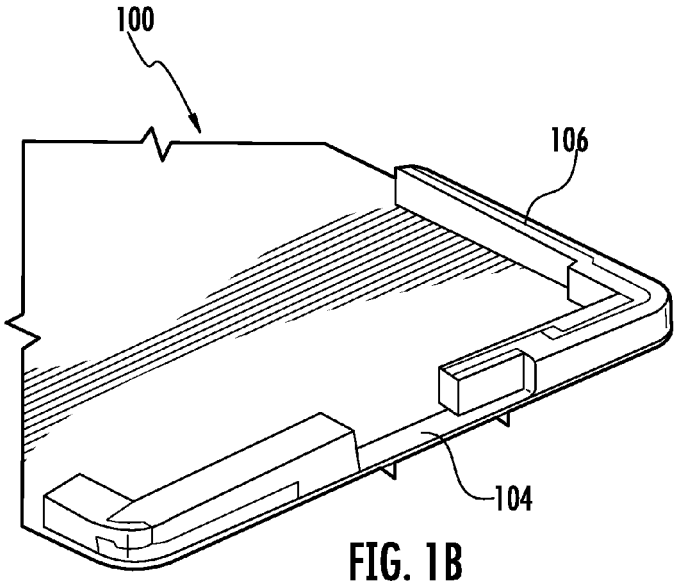

Referring now to FIGS. 1A and 1B, an exemplary embodiment of the antenna element 100 configured in accordance with the disclosure is shown and described.

As shown in FIG. 1A, the exemplary antenna apparatus 100 comprises a substrate (e.g., PCB) 102, having at least a portion thereof including a conductive ground plane 104. Peripheral non-conductive elements 106, 108 are disposed around the periphery of the substrate (in this embodiment, so as to substantially conform to the outer shape of the host device such as a smartphone), although it will be recognized that this is not a requirement, and other form factors/component dispositions may be used consistent with the disclosure.

The conductive traces 110 forming the various branches of the radiating elements 116, 118 (e.g., lower band radiator 116 and higher band radiator 118 in the exemplary embodiment) are disposed on the peripheral non-conductive elements in the desired patterns in order to effectuate radiation within the low and high bands.

FIG. 1A also illustrates a place 121 for a microUSB or other such connector (not shown). This connector is used with, inter alia, the tuner and procedure of FIG. 5 herein; i.e., the tuner is used in free space and the hand/head tunes the capacitively fed antenna in the band of interest. In an alternative embodiment, a separate antenna radiating element (e.g., for 2.3-2.7 GHz band) can be disposed in this region 121 as well.

The antenna element of FIG. 1A may also utilize a "lumped" capacitance 127, or alternatively a tunable component, such as e.g., a MEMS capacitor bank (high Q), or any other type of tunable/switchable capacitor element, such as an interdigital capacitor.

Separate high-band (HB) and low-band (LB) feeds, 112, 114 are utilized in the apparatus 100 of FIGS. 1A-1B, as illustrated. As discussed in greater detail subsequently herein, this approach affords certain advantages with respect to, inter alia, control of the LB and HB emissions and characteristics, as well as insertion loss of the antenna 100.

In an alternative embodiment, a separate antenna element (not shown) for e.g., a 2.3-2.7 GHz band is placed generally at the designate location 121. In some cases, it may be beneficial to have a separate radiator for certain prescribed bands (e.g., 2.3-2.7 GHz), and hence the present disclosure contemplates such separate antenna element is such cases.

Further, the capacitively coupled antenna apparatus 100 of FIG. 1A advantageously provides the freedom to locate the antenna impedance within a "Smith chart" (i.e., characteristic impedance or $Z_0$, that is the square root of the inductance/meter divided by the square root of the capacitance per meter of the conductive pathway, as is well known to those of ordinary skill in the radio frequency arts), such that it offers a desirable impedance region for the impedance tuner to operate, with reasonable insertion loss in the aforementioned freespace scenario. In freespace, the antenna has very high radiation efficiency, and thus it can accommodate for some drop in total efficiency due to slightly higher insertion loss by the tuner, while also simultaneously improving the matching. This is most clearly illustrated in FIGS. 2-4 herein.

Figure 2:
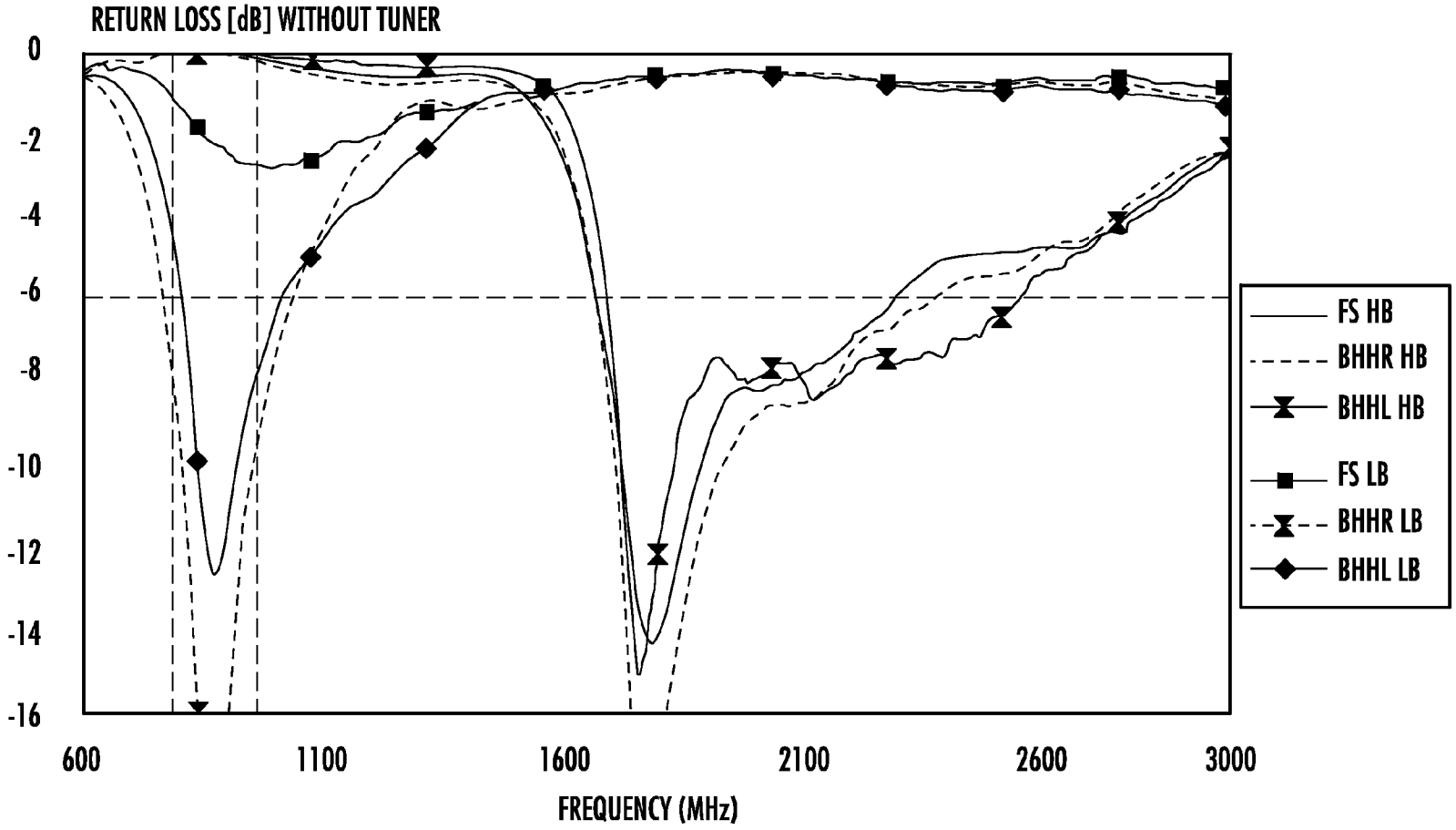
FIG. 2 is a graph of return loss (dB) versus frequency (without tuner) of the exemplary antenna of FIGS. 1A and 1B.

Specifically, FIG. 2 is a graph of return loss (dB) versus frequency (without tuner) of the exemplary antenna of FIGS. 1A and 1B. As illustrated in the Figure, the matching achieved is very good in the BHHR/L (beside head—hand R or L) scenario, thus avoiding the need for tuner in this scenario. In FS (freespace) the matching can be improved by using the tuner.

Figure 3:
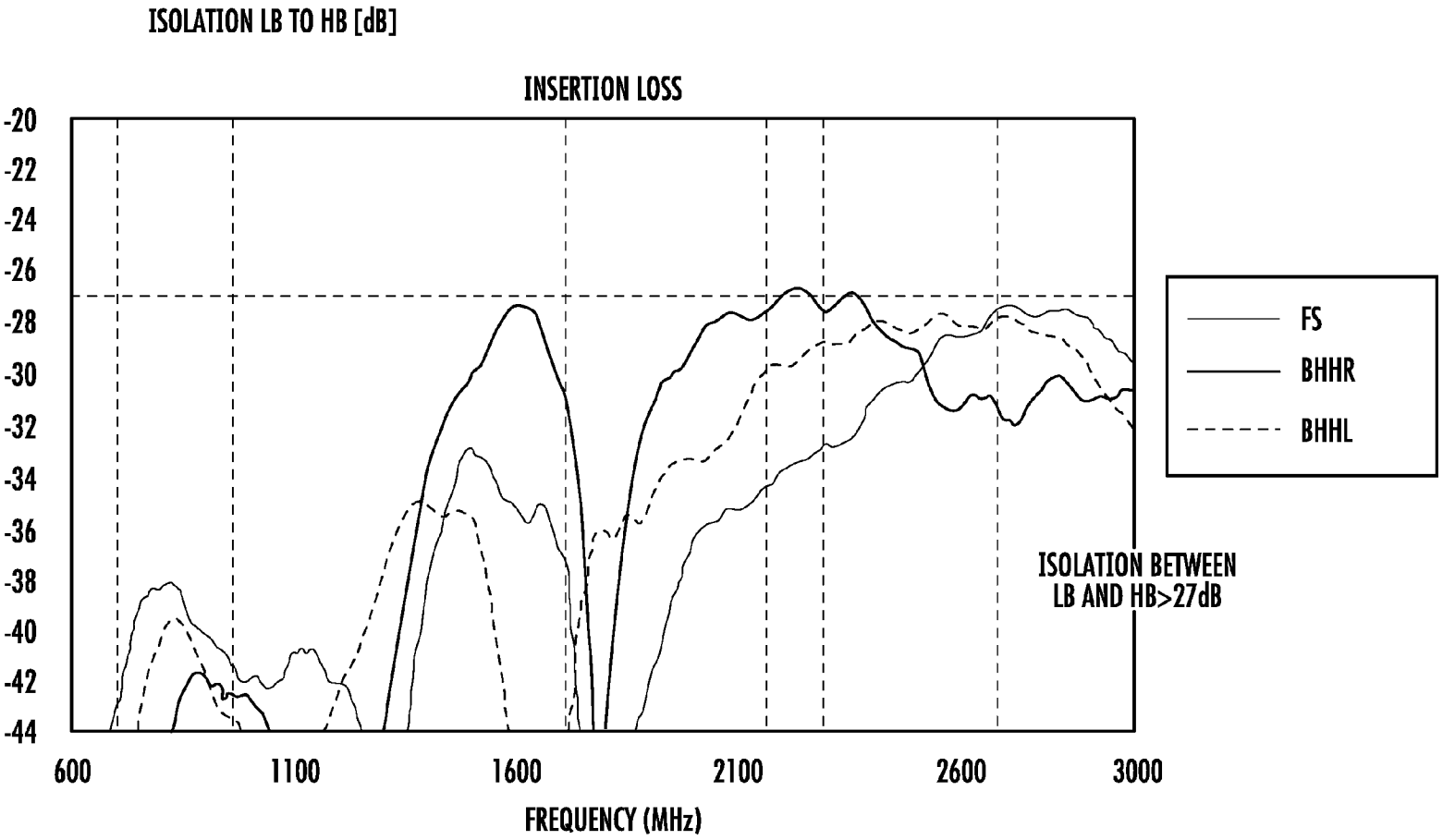
FIG. 3 is a graph of antenna isolation (dB) versus frequency from the lower antenna frequency band (LB) to the higher band (HB), for the exemplary antenna of FIGS. 1A and 1B.

FIG. 3 is a graph of antenna isolation (dB) versus frequency from the lower antenna frequency band (LB) to the higher band (HB), for the exemplary antenna of FIGS. 1A and 1B. Note that in the exemplary embodiment, a high isolation value between the lower band (LB) and higher band (HB) of >27 dB is advantageously achieved.

Figure 4:
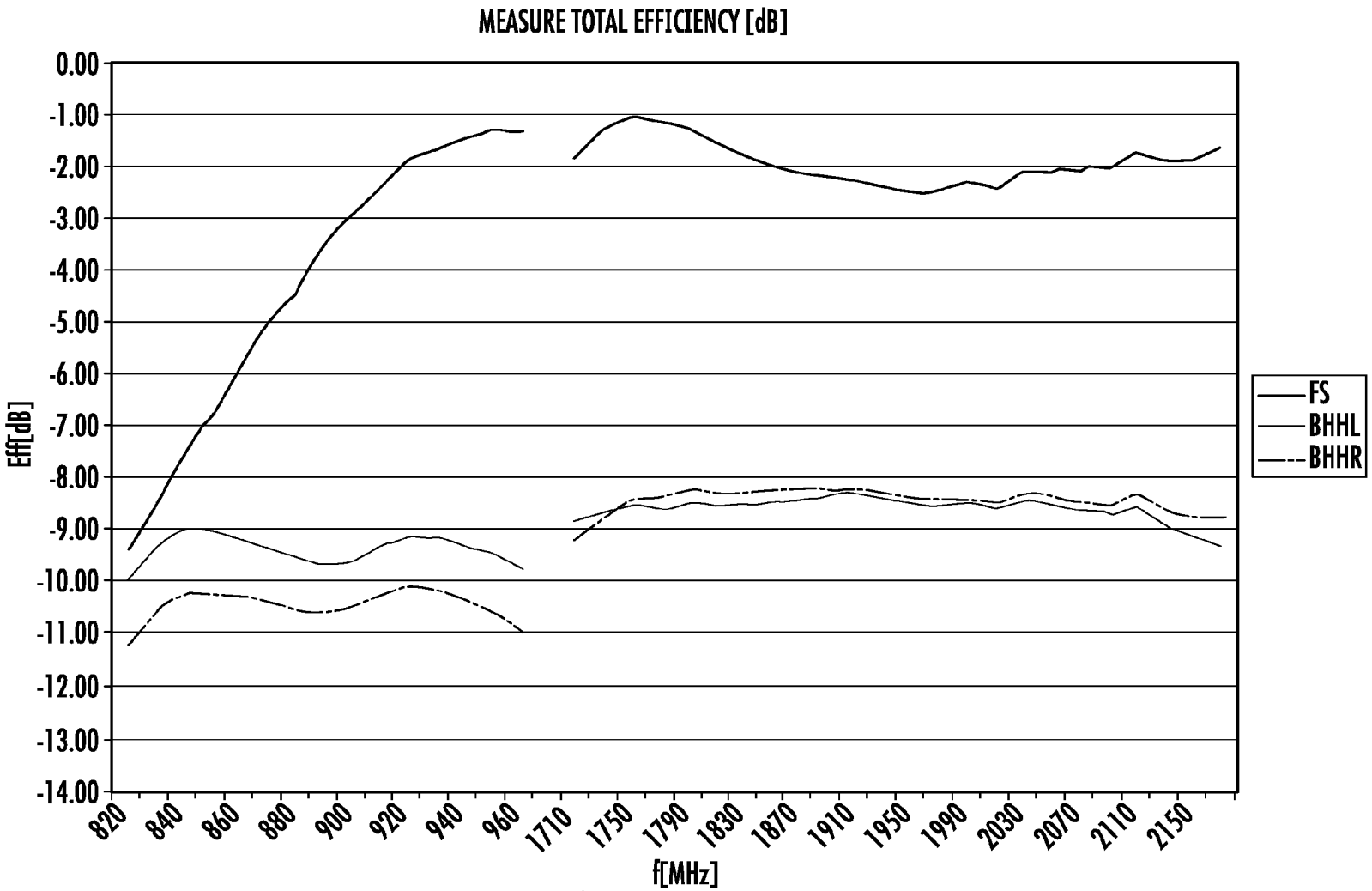
FIG. 4 is a graph of measured total efficiency as a function of frequency for the antenna of FIGS. 1A and 1B for various host device positions.
Figure 4A:
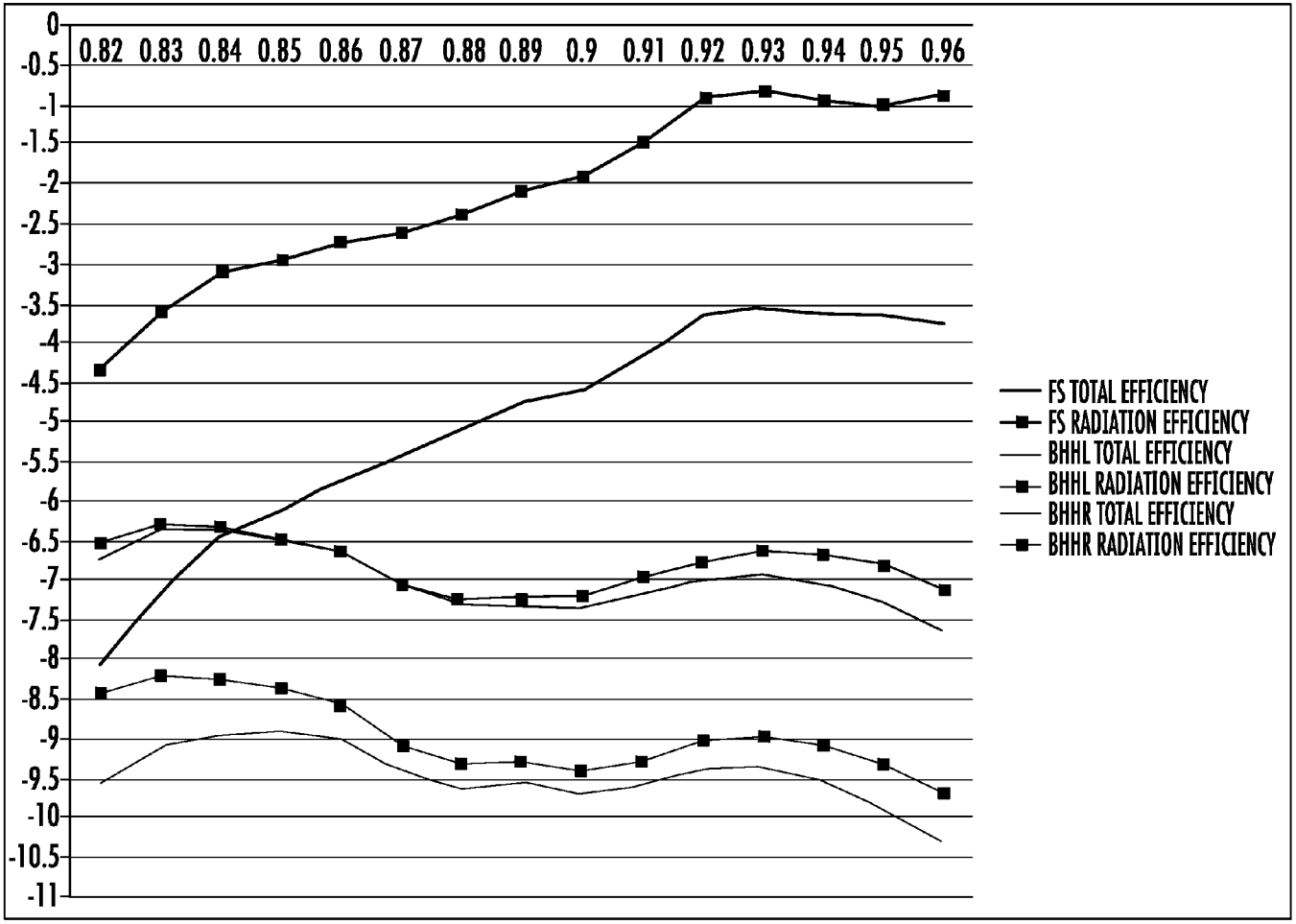
FIG. 4*a* is a graph of radiation and total efficiency for the antenna of FIGS. 1A and 1B for various host device positions.

FIG. 4 is a graph of measured total efficiency for the antenna of FIGS. 1A and 1B for various positions. As can be seen in FIG. 4, the potential for total efficiency is very good in the FS (freespace) condition, and the efficiency drops significantly in the other operating conditions mainly due to poor matching. In FS, the exemplary antenna is mismatched; thus, although the radiation efficiency is good, the total efficiency is less than desired (see also FIG. 4*a* showing radiation and total efficiencies for various configurations). An impedance tuner is used in the exemplary implementation to improve the matching of the antenna. In the BHHR and BHHL cases, the user's hand improves the matching of the antenna, as the hand acts as a capacitive load. Thus, the antenna matching improves significantly (as shown), and the tuner sees a very good match at both ends (i.e., the antenna end and the front end module or FEM end). Accordingly, a good total efficiency value is also achieved in BHHR/L cases.

Alternatively, through use of a bypass switch or similar mechanism in the tuner, the tuner can be completely bypassed for BHHR/L scenarios when the matching of the antenna is very good. Thus, in terms of the total efficiency, there exist "absorptive losses" by the hand and head, and no mismatch loss. For FS, there is a margin of acceptable radiation efficiency, and hence some additional insertion loss by the tuner (needed to improve the matching) is also acceptable.

Dual Feed Embodiment

The aforementioned operator requirements on FS (freespace) BHR/L (Beside Head Right/Left) and BHHR/L (Beside head hand right/Left) dictate that in order to optimize a given antenna for the different operating scenarios, it is beneficial to separate the feeds to the HB and the LB. This creates a requirement for a diplexer or similar apparatus to feed to a single feed "engine", where the signals are again separated into LB and HB by the diplexer internally. This architecture creates an insertion loss within the RF chain on the order of ≈0.5 dB (in the case of current wireless technologies individually), and an insertion loss of ≈0.5 dB+0.5 dB=1 dB (in the case of carrier aggregation, where the LB and HB frequencies are being utilized at the same time). This insertion loss can be eliminated by using a dual-feed front end module without a diplexer. This solution however requires an antenna with high port isolation (>25 dB) to replace the diplexer.

Hence, in another embodiment of the antenna apparatus, a high isolation value between the feed ports is implemented; this high isolation provides the ability to use a dual-feed RF front end module (without diplexer). The high isolation is created in the illustrated embodiment from the usage of the capacitive antenna structure, and by the usage of the tuner (matching circuit) for the low (or high) band. When the foregoing are used, a low pass filter is created (low band) or high pass filter (high band), thus improving the isolation between the bands.

It is further noted that the antenna feeds may be used to provide some of the aforementioned isolation functionality; i.e., LB feed disposed at e.g., the middle of the board, and the HB feed disposed at e.g., an end of the board. A grounded element such as a USB connector (or a third radiator element at e.g., 2.3-2.7 GHz radiator in the place of the USB connector, as described supra) further aids in improving the electromagnetic isolation between the LB and HB radiators.

The low insertion loss in the RF chain leads to better TRP (total radiated power) and TIS (total isotropic sensitivity) performance as well. Additionally, separating the feeds as described supra (i.e., into an LB feed and an HB feed) gives the designer more freedom to optimize the radiator pattern for low absorption loss for each of the HB and LB individually. Specifically, separation of the HB and LB feeds optimize the antenna patterns and performance for FS, BHR/L, BHHR/L scenarios, and reduce the insertion loss in the RF chain, thus giving a better overall system performance.

It will be appreciated from the foregoing that the exemplary embodiments of the antenna apparatus as disclosed herein has several advantages, including without limitation: (i) use of separate HB and LB feeds to optimize the antenna pattern for performance within FS, BHR/L, and BHHR/L use scenarios; (ii) reduction of the insertion loss in the RF chain (conductive pathway), thus giving a better overall system performance; (iii) the antenna apparatus 100 can be located on any side of the device, and tuned to cover the required band(s); (iv) well-known and low cost flex, ceramic, sheet metal, plated plastic parts, LDS (laser direct structuring) or other technologies can be used to create the structure(s) shown; (v) the operating bands are not limited to any specific frequencies, and hence may be applied to a variety of different wireless standards; and (vi) the antenna apparatus 100 can include switching/tuning/impedance tuning elements if desired (not shown), or a combination of all these techniques to improve the matching and to increase the antenna bandwidth.

In terms of manufacturing the antenna embodiments described above, known methods such as LDS, flex substrates, sheet metal, fluid deposition, 2-shot molding, and print deposition can be used to manufacture the various components as applicable, such techniques and structures being readily determined by those of ordinary skill when given the present disclosure.

Simplified Closed-Loop Tuning

In another aspect of the invention, simplified closed-loop antenna tuning apparatus and methodology are disclosed. Specifically, in one embodiment (shown in FIG. 5 herein), the simplified closed loop adaptive tuning approach of the invention eliminating the use of MCU and complex algorithms for tuning which consume current and increases the cost of the system. It also can advantageously be applied to any wireless system or technology/standard (e.g., GSM, WCDMA, LTE). Moreover, no additional information or algorithm support is needed from the baseband in order to effect the tuning approach.

Figure 5:
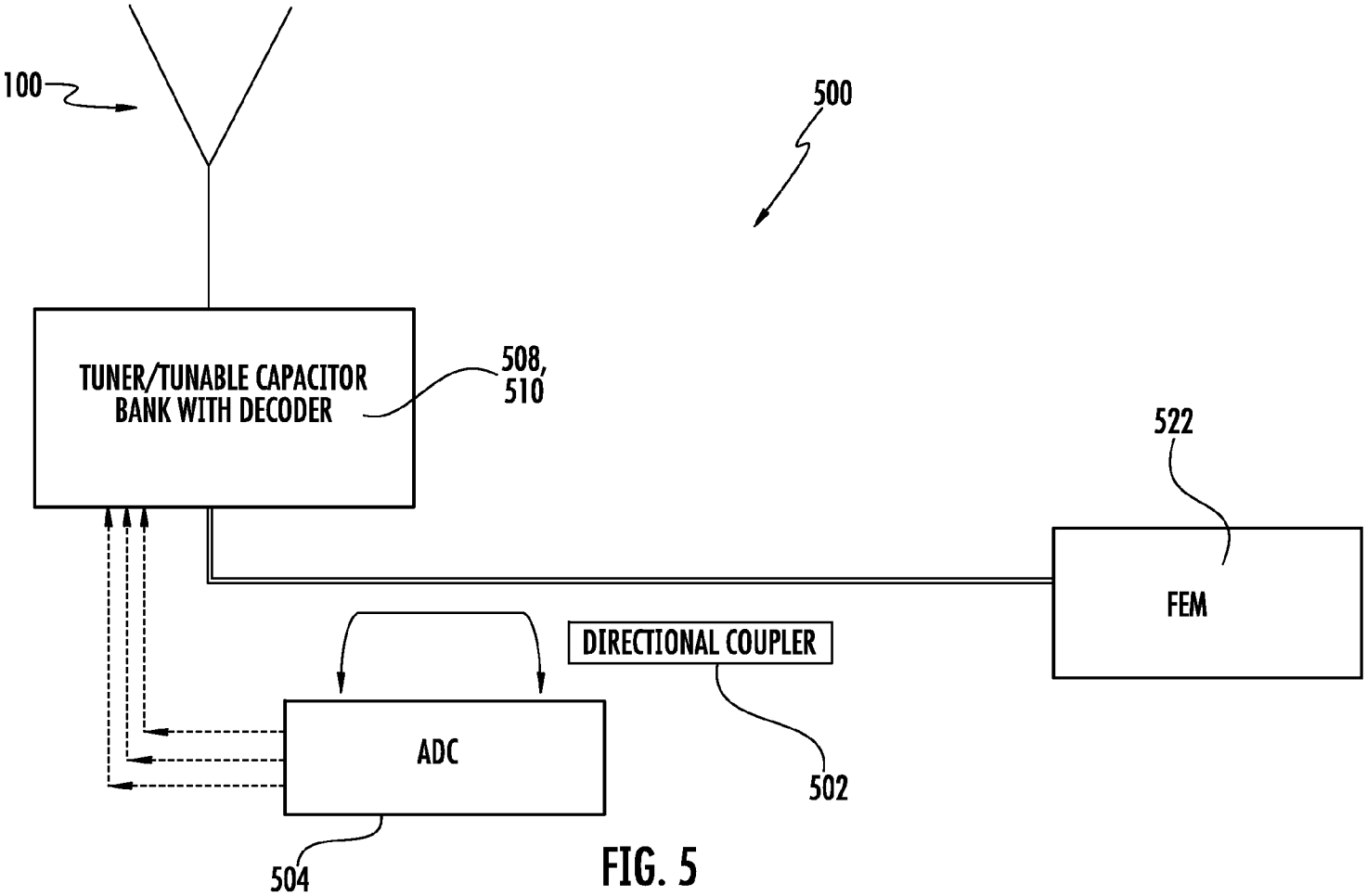
FIG. 5 is a block diagram of an exemplary closed loop adaptive tuning arrangement for the capacitively coupled antenna of FIGS. 1A-1B, according to one embodiment.

In the exemplary configuration 500 of FIG. 5, the directional coupler 502 detects the forward and reflected radio frequency power (from the RF front-end module, or FEM 522, and provides an output to the analog-to-digital converter (ADC) 504, and power to the voltage convertor (not shown). This digital value (i.e., from the ADC) and voltage are then fed to the decoder 508, which sets the states of the tuner 510 to a predefined value. It will be appreciated that while the decoder can receive frequency band information as an input from e.g., the baseband processor (not shown), it may be obtained from other sources. The tuner matches the antenna in the freespace (FS) scenario, when the impedance of the antenna is defined. Thus, the tuner in one implementation consults a look-up table or similar mechanism built internally to the device to set the required tuner state (i.e., if 1 tuner state is enough to cover the entire operating band). Alternatively, the decoder can obtain band information (e.g., from the baseband processor) and set the tuner state accordingly, so as to set the tuner to the required band of operation.

When the antenna is in an hand-held and/or beside-the-head operating condition, the antenna improves the matching. Thus, from the measured DC (measured in the illustrated embodiment at the Analog to Digital Converter), a feedback indicating the extent of mismatch is provided. For instance, when $S11 \approx < -10$ dB, the tuner switches either to a bypass switch, or chooses a predefined state having the least insertion loss, which has been predefined during the antenna design phase.

It will be appreciated that the antenna apparatus disclosed herein (e.g., that of FIGS. 1A and/or 1B, or yet other shapes) may be arranged in a wide variety of shapes and configurations; the foregoing shapes and array configurations are accordingly merely illustrative. Moreover, the various functions and features described herein may readily be applied to other types of antennas by those of ordinary skill given the present disclosure.

It will be recognized that while certain aspects of the disclosure are described in terms of a specific sequence of steps of a method, these descriptions are only illustrative of the broader methods, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure and claims provided herein.

While the above detailed description has shown, described, and pointed out novel features as applied to various embodiments, it will be understood that various omissions, substitutions, and changes in the form and details of the device or process illustrated may be made by those skilled in the art. The foregoing description is of the best mode presently contemplated. This description is in no way meant to be limiting, but rather should be taken as illustrative of the general principles of the disclosure.

What is claimed is:

1. A mobile device, comprising:

a housing;

a wireless transceiver;

an antenna in signal communication with the wireless transceiver and disposed substantially within or on the housing, the antenna comprising a high-band feed and a low-band feed; and a tuner in electrical communication with the antenna;

wherein the antenna is tuned using at least the tuner such that low antenna matching exists in a freespace condition, and capacitive loading imparted by a user during use of the mobile device further optimizes the antenna matching during such use without use of the tuner and separation of the high-band feed from the low-band feed is configured to improve a performance of the antenna in the freespace operating condition and in a capacitively loaded operating condition compared to performance of the antenna without the separation.

2. The mobile device of claim 1, further comprising a substrate configured to have at least a portion thereof comprise a conductive ground plane.

3. The mobile device of claim 2, further comprising a plurality of non-conductive elements disposed around a periphery of the substrate.

4. The mobile device of claim 3, further comprising a plurality of conductive traces configured to form a plurality of radiating elements, the plurality of conductive traces being disposed on the non-conductive elements in a pattern to effectuate radiation within a low band and a high band.

5. The mobile device of claim 1, further comprising a connector configured to have a separate antenna radiating element disposed therein.

6. The mobile device of claim 1, wherein the antenna comprises a lumped capacitance.

7. The mobile device of claim 1, wherein the antenna comprises a switchable capacitor element.

8. The mobile device of claim 1, further comprising at least one impedance tuning element configured to improve matching and to increase the antenna bandwidth.

9. The mobile device of claim 1, further comprising a diplexer apparatus configured to separate a signal into the high-band feed and the low-band feed.

10. The mobile device of claim 1, wherein the separation of the high-band feed and the low-band feed comprises a high port isolation between the high-band feed and the low-band feed of greater than 25 decibels (dB).

11. A mobile wireless device capable of operating in at least first and second frequency bands, comprising:

a wireless transceiver;

a front end module in signal communication with the wireless transceiver, the front end module comprising at least first and second signal feeds; and antenna apparatus in signal communication with the front end module, the antenna apparatus comprising a matching circuit;

wherein the matching circuit is configured to create a low pass filter for the first frequency band, and a high pass filter for the second frequency band, the second frequency band being higher in frequency than the first frequency band, the low- and high-pass filters providing increased isolation between at least the first and second signal feeds in low-band and high-band operation, respectively; and wherein use of the first and second signal feeds is configured to optimize a performance of the antenna apparatus in both a freespace operating condition and in a capacitively loaded operating condition.

12. The device of claim 11, wherein at least the increased isolation obviates the need for a diplexer for at least the first and second signal feeds.

13. The device of claim 11, wherein the antenna comprises an antenna that is capacitively loaded by a user during use, the capacitive loading further increasing the isolation.

14. The device of claim 11, further comprising a directional coupler, the directional coupler configured to detect forward and reflected radio frequency power from the front end module and output and output signal, the output signal being fed to an analog-to-digital converter (ADC).

15. The device of claim 14, wherein an ADC output from the ADC is fed to a decoder, the decoder configured to set a state of a tuner of the mobile wireless device.

16. A method of tuning an antenna, the antenna comprising a high-band feed and a low-band feed, the method comprising:

tuning the antenna in a freespace operating condition using a tuner having an insertion loss; and utilizing the tuned antenna such that a capacitively loaded operating condition is created when the antenna is placed into contact with a human, the capacitive loading further tuning the antenna without use of the tuner;

wherein use of the high-band feed and the low-band feed is configured to optimize a performance of the antenna in both the freespace operating condition and in the capacitively loaded operating condition; and wherein a return loss for the antenna is improved in the capacitively loaded operating condition as compared to when the antenna is in the freespace operating condition.

17. The method of claim 16, wherein the use of the capacitive loading to further tune the antenna without use of the tuner reduces an insertion loss for the antenna that would otherwise be introduced by the tuner.

18. The method of claim 17, further comprising using the reduced insertion loss to enhance TRP (total radiated power) and TIS (total isotropic sensitivity) performance.

19. The method of claim 17, wherein the tuning the antenna in the freespace operating condition comprises tuning so that the antenna matching or return loss is poor.

20. The method of claim 16, wherein the act of tuning the antenna in the freespace operating condition using the tuner having the insertion loss further comprises consulting a look-up table for determining a required tuner state of the antenna in the freespace operating condition.

* * * * *